US005382177A

United States Patent [19]

Hutchinson, Jr. et al.

[11] Patent Number: 5,382,177

[45] Date of Patent: Jan. 17, 1995

[54] CONNECTOR HOUSING WITH IMPROVED LATCH MEMBERS

[75] Inventors: Richard D. Hutchinson, Jr., Greensboro; Daines M. Self, Jr., Oak Ridge; Michael P. Trull, Winston-Salem, all of N.C.

[73] Assignee: The Whitaker Corporation, Wilmington, Del.

[21] Appl. No.: 795,583

[22] Filed: Nov. 21, 1991

[51] Int. Cl.[6] ..... H01R 13/627

[52] U.S. Cl. ..... 439/358; 439/350

[58] Field of Search ..... 439/350, 351, 352, 353, 439/355, 357, 358; 285/319, 320, 921; 403/326, 321, 319

[56] References Cited

U.S. PATENT DOCUMENTS

| | | | |
|---|---|---|---|
| 3,366,729 | 1/1968 | Pauza | 174/138 |
| 3,399,376 | 8/1968 | Pauza et al. | 339/91 |
| 3,573,716 | 4/1971 | Garver | 339/128 |
| 4,293,180 | 10/1981 | Taylor | 439/744 |
| 4,310,211 | 1/1982 | Bunnell et al. | 439/358 |
| 4,335,929 | 6/1982 | Abernethy | 439/358 |
| 4,443,048 | 4/1984 | Moist, Jr. | 439/599 |
| 4,944,693 | 7/1990 | Puerner | 439/358 |
| 5,011,425 | 4/1991 | Van Zanten et al. | 439/358 |

*Primary Examiner*—Gary F. Paumen
*Assistant Examiner*—Hien D. Vu
*Attorney, Agent, or Firm*—Bruce J. Wolstoncroft

[57] ABSTRACT

A connector housing includes a pair of latch arms along sides thereof which extend forwardly to latch with corresponding latching means of a housing of a mating connector. Each latch arm is joined integrally to the housing sides by flexible hinge joints which allow the deflection of the latch arm during mating and unmating. The hinge joints include midsections which have enlarged ends extending therefrom. Radiused sections are provided on the enlarged ends, the radiused sections are configured to properly distribute the stresses associated with the latch arms, such that as forces are applied to the latch arms concentration of stresses will be avoided on the hinge joints.

18 Claims, 5 Drawing Sheets

CONNECTOR HOUSING WITH IMPROVED LATCH MEMBERS

FIELD OF THE INVENTION

The invention relates to improved latch members for use with an electrical connector housing. In particular, the latch members are configured to eliminate stress concentration points, thereby minimizing the potential for latch breakage.

BACKGROUND OF THE INVENTION

Housings for certain electrical connector are molded from dielectric plastic material and are intended to be secured to mating connector housings when the connectors have been moved together in a mated condition, in which the respective arrays of electrical contacts are mated to complete electrical connections. In some of these connectors, hardware is fastened to the respective housings to secure them together in their mated condition, but it is desirable that the housings have an integral latching means. Integrally molded latch arms are disposed along opposed sides of the housing of one of the connectors and extend forwardly to latchingly engage corresponding latching surfaces of the housing of the other connector, when the connectors are moved together into a mated condition.

Latch arms used for securing connectors together are known in U.S. Pat. No. 4,867,700 and assigned to assignee hereof. The latch arms include rearward portions which are deflectable to unlatch the latch arms when it is desired to separate and unmate the connectors, in which case the latch arms can be said to be hingedly joined to the housing. Such latch arms are subjected to stress and torque during mating and unmating of the connectors, and the hinge joint must be rugged and durable to withstand many cycles of mating and unmating, especially taking into consideration that the hinge joint is molded of plastic material which can commonly lose strength over time when worked and subjected to temperature cycling as well.

It is desired to provide hinge joints for latch arms of connector housings which are designed to resist stress and torque and yet be flexible to allow many cycles of deflection of the latch arms.

SUMMARY OF THE INVENTION

The present invention is directed to a hinge joint for joining a deflectable section to a connector housing. The hinge joint has a midsection with enlarged first and second ends. Radiused sections are provided on the first and second ends. The midsection and the enlarged ends extend between and are integrally attached to the deflection section and the connector housing. The configuration of the hinge joint ensures that as forces are applied to the deflectable section, the associated stresses of the hinge joint will be distributed such that concentration of stresses will be eliminated, thereby reducing the possibility of hinge joint failure.

The invention is also directed to a connector housing molded of plastic material and matable with a corresponding connector housing. The connector housing has a pair of latch arms on opposite sides thereof having respective latching members at forward free ends thereof. The latch arms cooperate with latching means of the corresponding connector housing to maintain the connector housings in a mated condition. Each latch arm is joined to a respective side of the housing at a hinge joint which is spaced a selected distance rearwardly from the forward free end of the latch arm. The hinge joints have midsections with first and second ribs integrally attached to the midsections. The first ribs are positioned at first ends of the midsections and the second ribs are positioned at second ends of the midsections. The first and second ribs extend beyond sidewalls of the midsections in a direction which is essentially perpendicular to the longitudinal axis of the midsections. The midsections and the first and second ribs extend between and are integrally attached to the latch arms and the connector housing. The configuration of the hinge joints ensures that as forces are applied to the latch arm, the associated stresses of the hinge joint will be distributed to the first and second ribs to prevent the failure of the hinge joint.

It is an objective of the invention to provide a hinge joint for each latch arm of a connector housing which is capable of flexure to allow deflection of the latch arm during mating and unmating of the connector with a mating connector.

It is a further objective for such a hinge joint to resist stress and torque and be durable over many cycles of latch arm deflection, allowing many cycles of connector mating and unmating.

An embodiment of the hinge joint will now be described with respect to the accompanying drawings.

DETAILED DESCRIPTION OF THE INVENTION

Figure 1:
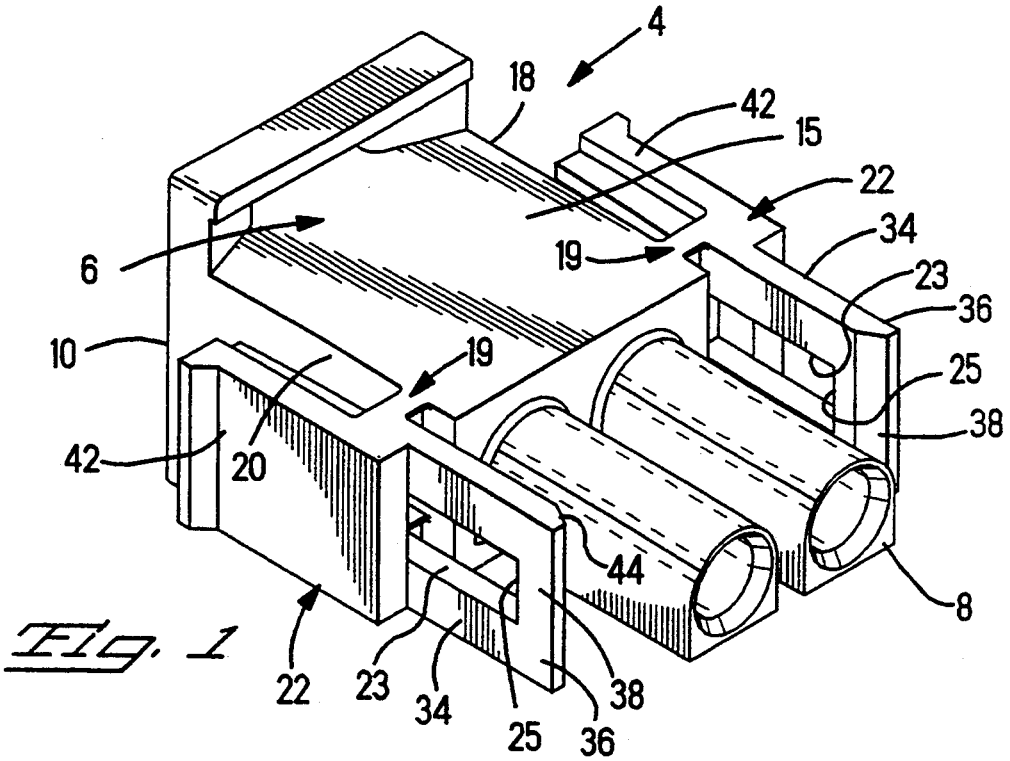
FIG. 1 is a perspective view of a connector housing having a pair of latch arms joined thereto by hinge joints of the present invention.
Figure 2:
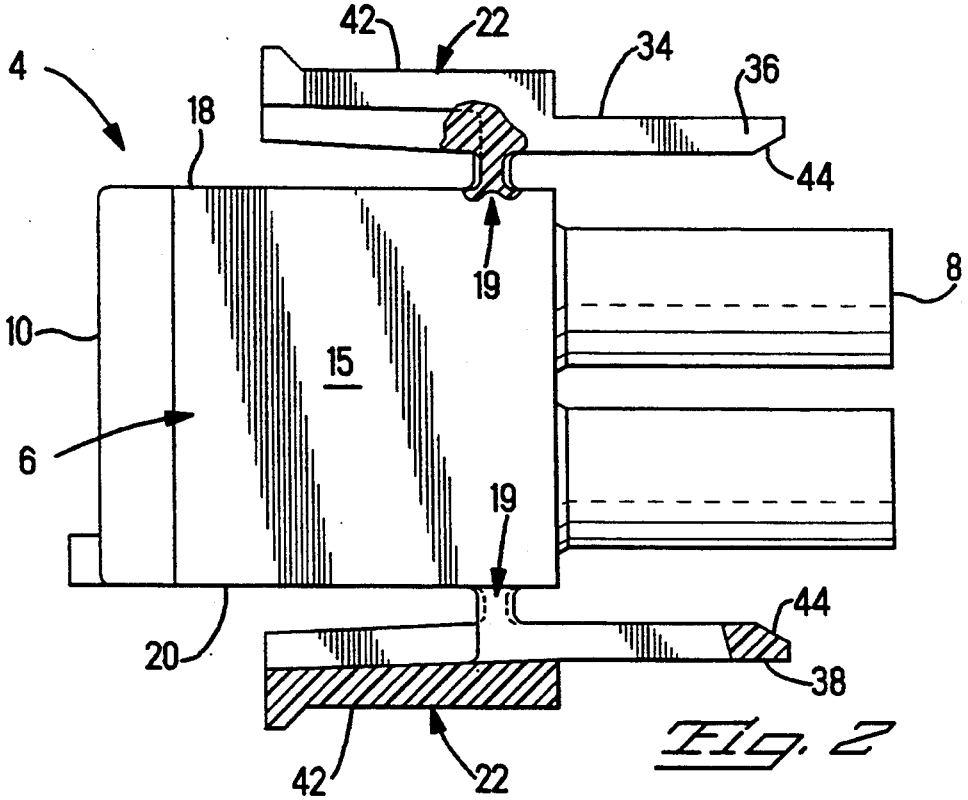
FIG. 2 is a top plan view of the connector housing with portions of the latch arms shown in cross-section to illustrate the hinge joints which join the latch arms to the connector housing.
Figure 3:
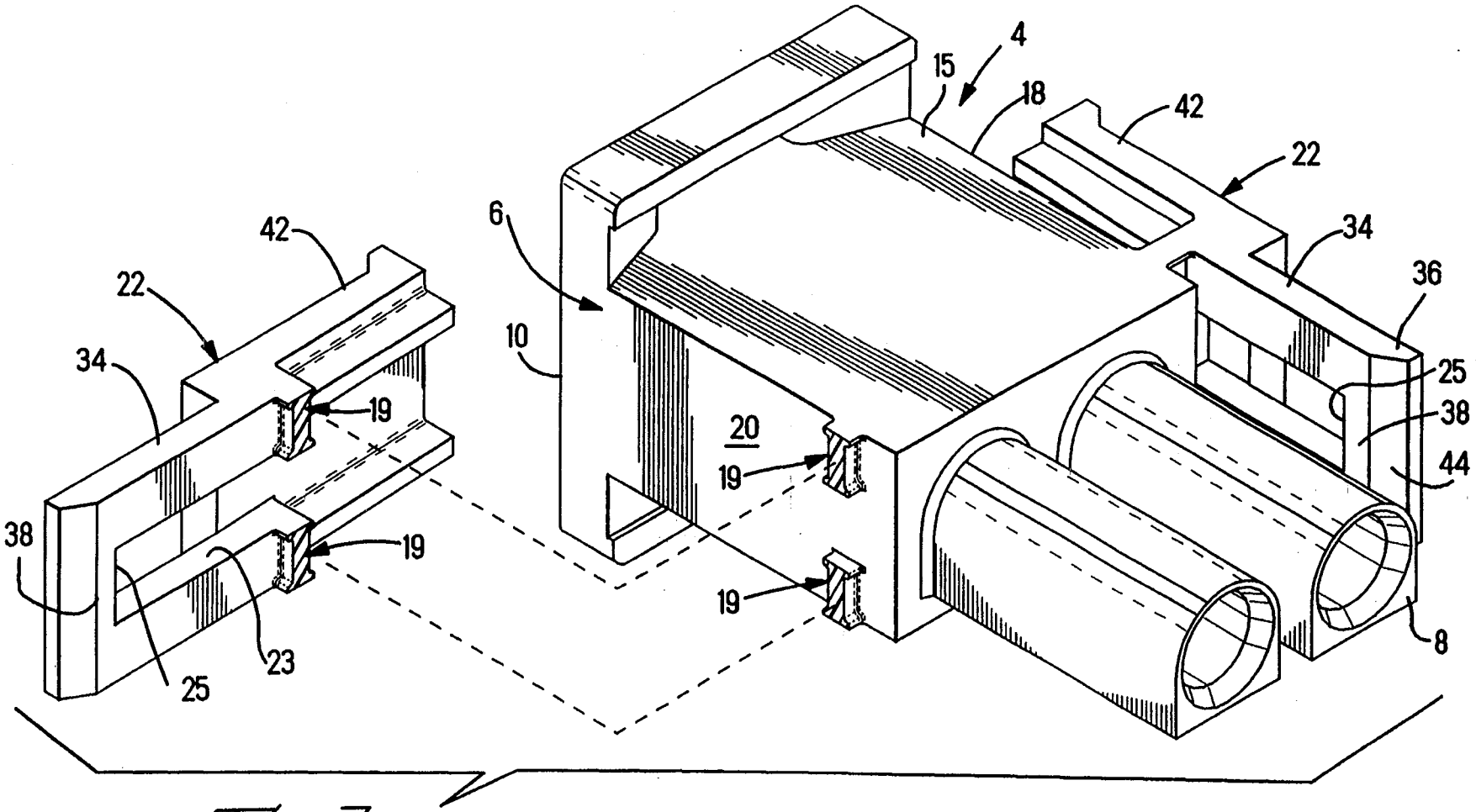
FIG. 3 is a perspective view of the connector housing and a latch arm thereof broken away from the connector housing to expose the hinge joint of the present invention.
Figure 6:
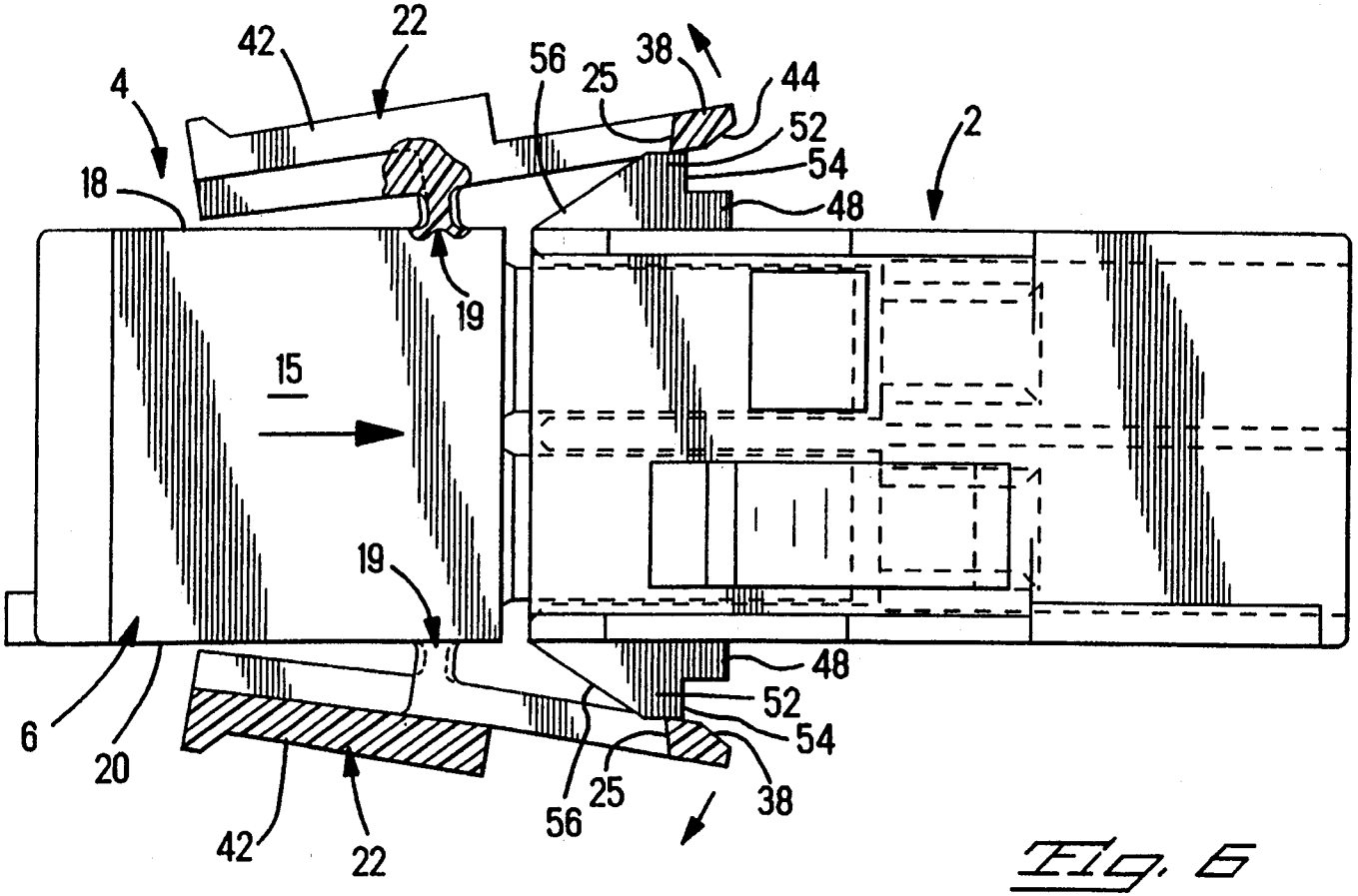
FIG. 6 is a top plan view of the connector housing being mated to a mating connector housing.
Figure 7:
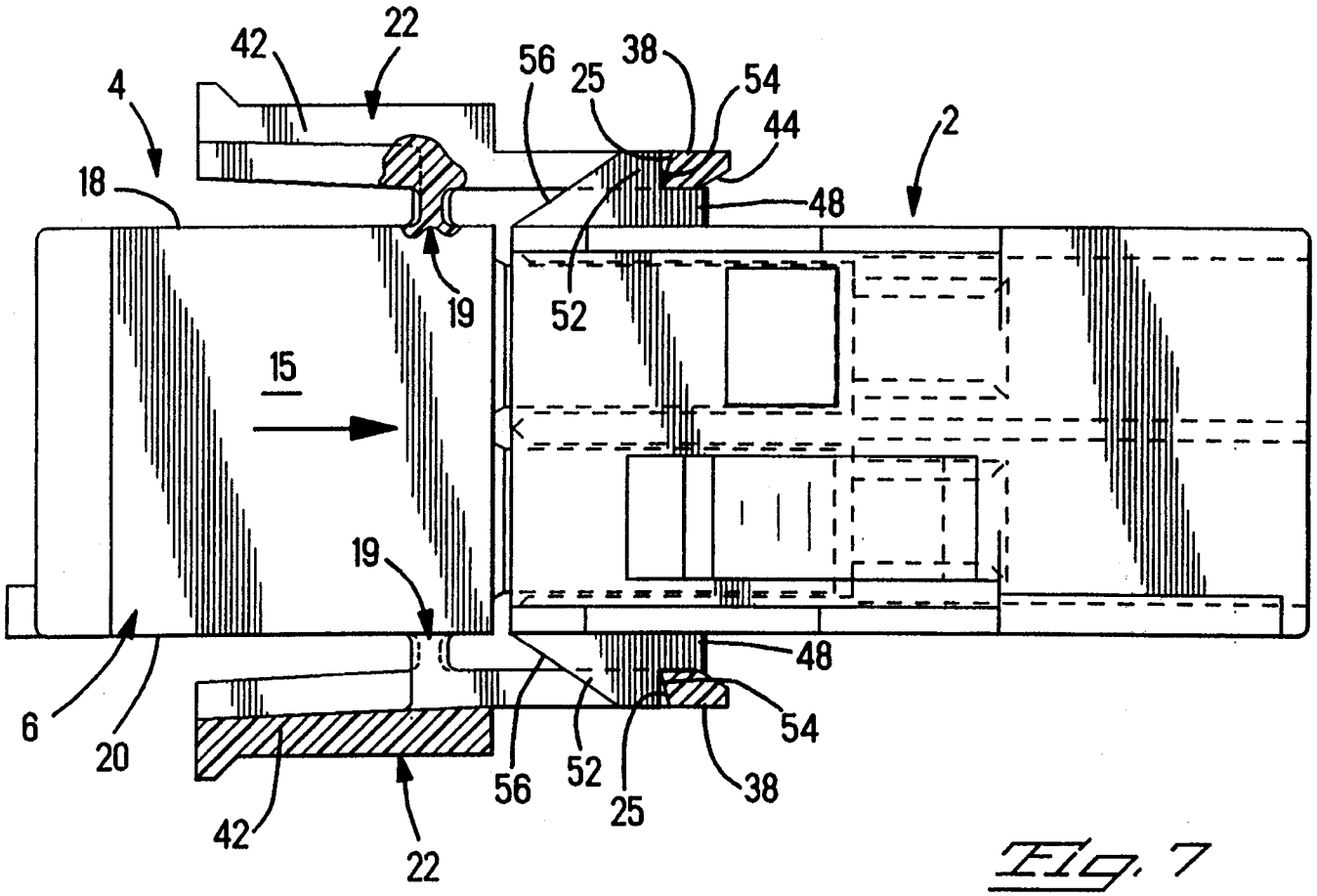
FIG. 7 is a top plan view, similar to FIG. 6, of the connector housing and the mating connector housing in the mated condition.

Referring to FIGS. 1, 6 and 7, a preferred form of connector assembly in accordance with invention comprises a plug connector 4 and a receptacle connector 2. The plug connector 4 comprises a block 6 of insulating material, such as nylon, having a mating face 8 and a rearward face 10. A plurality of contact receiving cavities 12 extend axially through the block from the rearward face to the mating face and are adapted to receive contact terminals which are crimped onto wires. The plug connector 4 contains contact sockets which are adapted to receive the projection ends of contact pins contained in the receptacle connector 2 of the connector assembly.

Block 6 has upper and lower surfaces 15, 17 and side surfaces 18, 20 on which latch arms 22 are provided. The latch arms 22 are generally flat platelike members integrally joined to the sides of the housing at respective flexible integral hinge joints 19 located approximately midway along the latch arms. Each latch arm 22 includes a forward portion 34 concluding in a free end 36 having a latching member 38. The forward portions 34 have grooves 23 which extends from proximate the hinge joints 19 to the latching members 38. Rearwardly facing shoulders 25 are provided at the interfaces between the latching members 38 and the grooves 23. These shoulders 25 are adapted to cooperate with barbed ends 52 of latch arms 48 which are mounted on the corresponding sides of the receptacle 2, as best shown in FIGS. 6 and 7. Latch arms 22 further include rearward portions 42 which extend rearwardly from the hinge joints 19. The rearward portions 42 are configured to allow the user to grip the portions and release the plug connector 4 from the receptacle connector 2, as will be more fully described.

During the mating of the connectors, latch arms 22 are deflected outwardly around respective pivot axes (which pass through the hinge joints 19) as latching members 38 ride over barbed ends 52 of latch arms 48, as shown in FIG. 6. Upon mating, latching members 38 are moved beyond the barbed ends 52, such that the barbed ends 52 are positioned in the grooves 23. In this position shoulders 25 of latch arms 22 cooperate with shoulders 54 of latch arms 48 to prevent inadvertent delatching caused by stress or vibration when the connectors are in their mated condition. The connector-proximate portions of latch arm free ends 36 preferably include an angled surface 44 to engage angled surfaces 56 of barbed ends 52 and bear thereagainst to initiate deflection of the latch arms 22 outwardly. During unmating, rearward latch arm portions 42 are adapted to be urged toward each other, rotating latch arms 22 about their respective hinge joints to delatch latching members 38 from barb ends 52, whereupon the plug connector 4 can be move rearwardly away from the receptacle connector 2.

Figure 4:
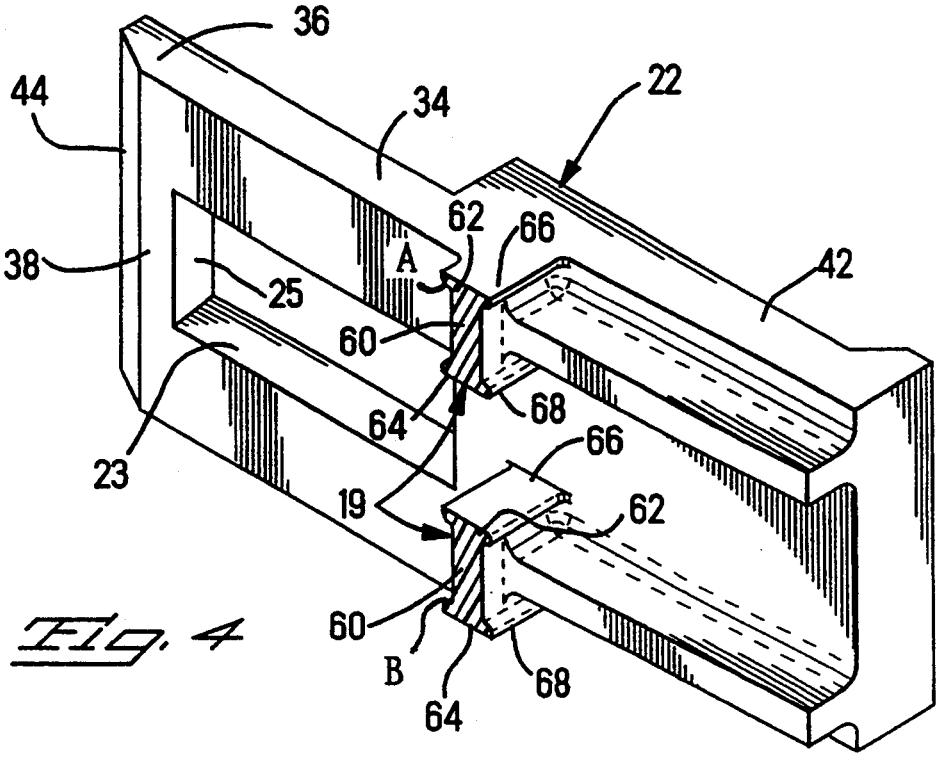
FIG. 4 is a perspective view of the latch arm of the present invention.
Figure 5:
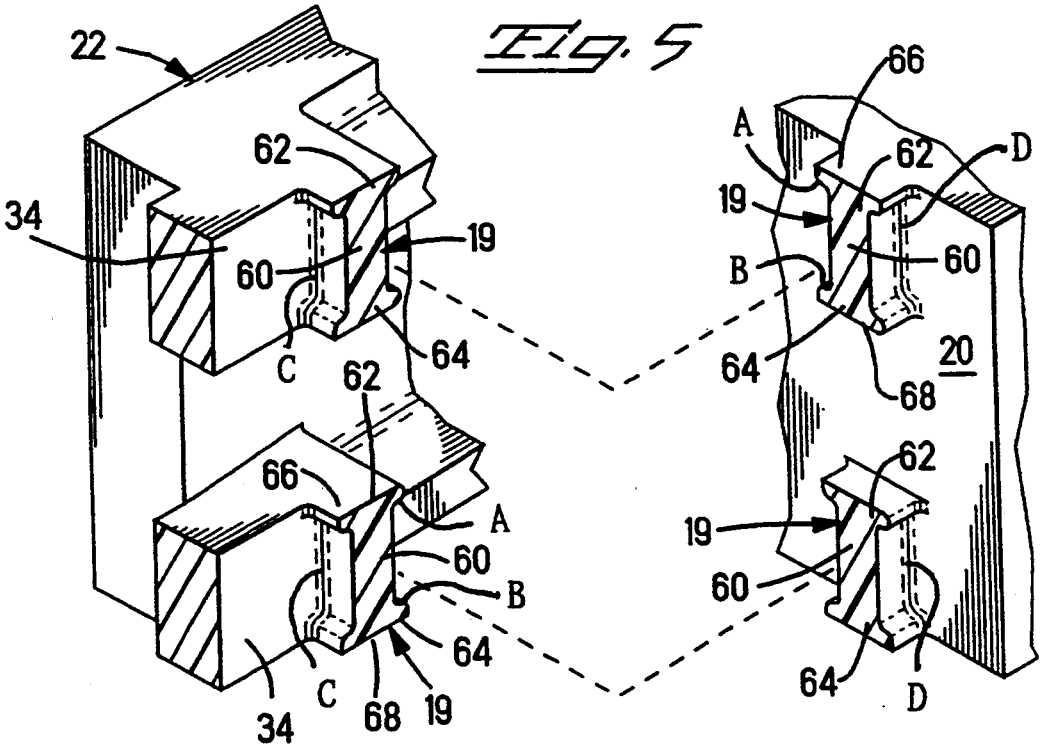
FIG. 5 is a partial perspective view, similar to that of FIG. 3, of the latch arm broken away from the housing to expose the hinge joint.

Each latch arm 22 has a pair of hinge joints 19, as best shown in FIGS. 4 and 5. Each hinge joint is capable of flexure during the deflection of the latch arm. For ease of explanation and understanding, the detailed description for one hinge joint will be provided. However, all hinge joints are identical and the detailed explanation provided applies to each of the hinge joints.

Referring to FIGS. 4 and 5, hinge joint 19 has a cross section lying in a plane parallel to the pivot axis, the cross section having a narrow midsection 60 with enlarged ends or ribs 62, 64 integrally attached thereto at respective ends thereof. The ribs 62, 64 extend from the midsection 60 to respective end surfaces 66, 68.

In cross-section the ribs 62, 64 extend beyond the sidewalls of the midsection 60 to give the hinge joint a "dogbone" configuration, as best shown in FIG. 5. In this configuration the longitudinal axis of each rib extends in a direction which is essentially perpendicular to the longitudinal axis of the midsection.

As is illustrated in the figures, the hinge joint has first radiused sections A and second radiused sections B. Sections A join the midsection 60 to the ribs 62, 64 and sections B are provided on ribs 62, 64 proximate end surfaces 66, 68.

As best shown in FIGS. 4 and 5, the hinge joint 19 also has radiused sections C and D. Sections C are provided at the interface between the latch arm and the hinge joint. Sections D are provided at the interface between the housing and the hinge joint. Each of the radiused section C and D extend from the first end surface 66 of the hinge joint to the second end surface 68. The radiused sections C and D, therefore, cooperate with and are integral with the midsection 60 and the ribs 62, 64.

The use of ribs 62, 64 and radiused sections A, B, C and D are provided to reduce and distribute the stresses associated with the function of the latch arm across the entire width of the hinge joint. The distribution of stresses reduces the potential of hinge joint breakage and eliminates stress concentration of the hinge joint.

In the embodiment shown, the radiused sections A and B have a radius in the range of 0.005" to 0.010" and the radiused sections C and D have a radius in the range of 0.015" to 0.020". The ribs 62, 64 extend beyond the sidewalls of the midsection by a distance of between 0.010" to 0.015". This configuration is considered optimum for the connector illustrated in the drawings.

In connectors of this type, the hinge joint 19 is subjected to various forces including pull-out forces and displacement forces. The pull-out forces occur when the plug connector 4 is pulled away from the receptacle connector 2 without disengaging the latch arms. These pull-out forces have an axial component and a rotational component associated therewith. The displacement forces are the forces associated with the rotation of the latch arms from the mating position to the unmating position. Both the pull-out and displacement forces are transmitted to the hinge joint causing the hinge joint to be stressed. As each force is different, the stress distribution on the hinge joint varies for each force. Consequently, the optimum design for the hinge joint must be one which allows the for flexibility of the joint and which can accommodate the various stress distributions without failure. For the connector illustrated, this optimum design is described above.

Although in the embodiment disclosed an optimum configuration of the hinge joint is presented, it is important to note that in other connectors different optimum ranges may be applicable. However, the basic configuration of the "dogbone" hinge joint would remain the same.

Changes in construction will occur to those skilled in the art and various apparently different modifications and embodiments may be made without departing from the scope of the invention. The matter set forth in the foregoing description and accompanying drawings is offered by way of illustration only.

We claim:

1. A hinge joint for joining a deflectable section integrally to a plastic housing, the hinge joint having a pivot axis about which said deflectable section pivots and having a cross section comprising a narrow midsection with first and second enlarged ribs integrally attached to the midsection, the first rib is positioned at a first end of the midsection and the second rib is positioned at a second end of the midsection, the longitudinal axis of the first and second ribs extends in a direction which is essentially perpendicular to the longitudinal axis of the midsection, the first and second ribs extend beyond sidewalls of the midsection, the midsection and the first and second ribs extend between and are integrally attached to the deflectable section and the housing, said cross section lying in a plane parallel to said pivot axis, whereby as forces are applied to the deflectable section, the associated stresses of the hinge joint will be distributed to the first and second ribs to prevent the failure of the hinge joint.

2. A hinge joint as recited in claim 1 wherein first radiused sections are provided on the hinge joint, the first radiused sections provide the transition between the hinge joint and the latch arm.

3. A hinge joint as recited in claim 2 wherein second radiused sections are provided on the hinge joint, the second radiused sections provide the transition between the hinge joint and the housing.

4. A hinge joint as recited in claim 1 wherein third radiused sections are provided on the hinge joint, the third radiused sections provide the transition between the midsection and the first and second ribs.

5. A hinge joint as recited in claim 4 wherein fourth radiused sections are provided on the hinge joint, the fourth radiused sections are provided on the first and second ribs proximate end surfaces thereof.

6. A hinge joint as recited in claim 3 wherein the radius of each of the first radiused sections is between 0.015 inches and 0.020 inches.

7. A hinge joint as recited in claim 6 wherein the radius of each of the second radiused sections is between 0.015 inches and 0.020 inches.

8. A hinge joint as recited in claim 5 wherein the radius of each of the third and fourth radiused sections is between 0.005 inches and 0.010 inches.

9. A hinge joint as recited in claim 1 wherein the first and second ribs extend beyond the sidewalls of the midsection by a distance between 0.010 inches and 0.015 inches.

10. A connector housing molded of plastic material and matable with a corresponding connector housing and having a pair of latch arms on opposite sides thereof having respective latching members at forward free ends thereof latchable with corresponding latching means of the corresponding connector housing, the latch arms are joined to respective sides of the housing at hinge joints spaced a selected distance rearwardly from the forward free ends of the latch arms, the hinge joints each having a pivot axis about which the respective latch arm pivots and having cross sections comprising midsections with first and second ribs integrally attached to the midsections, the first ribs are positioned at first ends of the midsections and the second ribs are positioned at second ends of the midsections, the longitudinal axis of the first and second ribs extends in a direction which is essentially perpendicular to the longitudinal axis of the midsections, the first and second ribs extend beyond sidewalls of the respective midsections, the midsections and the first and second ribs extend between and are integrally attached to the latch arms and the connector housing, said cross sections lying in planes parallel to said pivot axes, whereby as forces are applied to the latch arms, the associated stresses of the hinge joints will be distributed to the first and second ribs to prevent the failure of the hinge joints.

11. A connector housing as recited in claim 10 wherein the latch arms have forward portions and rearward portions, the forward portions have free ends with the latching members provided thereon, the rearward portions extend rearwardly from the hinge joints and are configured to enable delatching and unmating of the connector housing from the corresponding connector housing.

12. A connector housing as recited in claim 11 wherein first and second radiused sections are provided on each hinge joint, the first radiused sections provide the transition between the hinge joints and the latch arms, and the second radiused sections provide the transition between the hinge joints and the housing.

13. A connector housing as recited in claim 12 wherein third and fourth radiused sections are provided on each hinge joint, the third radiused sections provide the transition between the midsection and the first and second ribs, and the fourth radiused sections are provided on the first and second ribs proximate the end surfaces thereof.

14. A hinge joint for joining a deflectable section to a connector housing, the hinge joint having a pivot axis about which said deflectable section pivots and having a cross section comprising a midsection with enlarged first and second ends, the longitudinal axis of the first and second ends extend in a direction which is essentially perpendicular to the longitudinal axis of the midsection, radiused sections are provided on the first and second ends, the midsection and the first and second ends extend between and are integrally attached to the deflectable section and the connector housing, said cross section lying in a plane parallel to said pivot axis, whereby the configuration of the hinge joint ensures that as forces are applied to the deflectable section the associated stresses of the hinge joint will be distributed such that concentration of stresses will be eliminated.

15. A hinge joint as recited in claim 14 wherein first radiused sections are provided on the hinge joint, the first radiused sections provide the transition between the hinge joint and the latch arm.

16. A hinge joint as recited in claim 15 wherein second radiused sections are provided on the hinge joint, the second radiused sections provide the transition between the hinge joint and the housing.

17. A hinge joint as recited in claim 14 wherein third radiused sections are provided on the hinge joint, the third radiused sections provide the transition between the midsection and the first and second ribs.

18. A hinge joint as recited in claim 17 wherein fourth radiused sections are provided on the hinge joint, the fourth radiused sections are provided on the first and second ribs proximate end surfaces thereof.

* * * * *